United States Patent [19]

Coyle, Sr.

[11] Patent Number: 4,479,538

[45] Date of Patent: Oct. 30, 1984

[54] CASING SCRAPER AND METHOD FOR MAKING THE SAME

[75] Inventor: William E. Coyle, Sr., Houma, La.

[73] Assignee: Bilco Tools, Inc., Houma, La.

[21] Appl. No.: 275,790

[22] Filed: Jun. 22, 1981

[51] Int. Cl.[3] ..... E21B 37/02

[52] U.S. Cl. ..... 166/173; 308/4 A; 15/104.16; 403/356

[58] Field of Search ..... 166/173, 170, 174–176; 15/104.16, 104.17, 104.05, 104.09; 308/4 A; 175/325; 29/445, 463; 407/35, 53, 31; 408/713, 224, 230; 403/318, 356, 261, 331; 30/329, 335; 76/101 R, 101 A

[56] References Cited

U.S. PATENT DOCUMENTS

| | | | |
|---|---|---|---|
| Re. 24,766 | 1/1960 | Scivally | 166/173 |
| 1,664,283 | 3/1928 | Boynton | 166/102 |
| 2,275,939 | 3/1942 | Baker | 166/173 |
| 2,515,149 | 7/1950 | Willhoit | 166/241 |
| 2,627,925 | 2/1953 | Scivally | 166/173 |
| 2,667,930 | 2/1954 | Saurenman et al. | 166/173 |
| 2,667,931 | 2/1954 | Baker | 166/173 |
| 2,695,673 | 11/1954 | Coyle | 166/170 |
| 2,804,152 | 8/1957 | Scivally | 166/173 |
| 2,811,210 | 10/1957 | Guillot | 166/173 |
| 2,838,121 | 6/1958 | Coyle | 166/173 |
| 2,845,129 | 7/1958 | Baker | 166/173 |
| 3,276,521 | 10/1966 | Turbyfill | 166/173 |
| 3,326,294 | 6/1967 | Neilson | 166/173 |
| 4,074,594 | 2/1978 | Dall et al. | 76/101 A |
| 4,135,414 | 1/1979 | Hang et al. | 76/101 A |
| 4,189,000 | 2/1980 | Best | 166/173 |
| 4,242,927 | 1/1981 | Oaks | 76/101 A |

*Primary Examiner*—Stephen J. Novosad
*Assistant Examiner*—Hoang C. Dang
*Attorney, Agent, or Firm*—Charles W. Fallow; Martin P. Hoffman

[57] ABSTRACT

A scraping tool for cleaning well casing bores comprising an elongated support body, at least a pair of opposed sets of scraper blades mounted in slots in the body, an intermediate undercut between the sets of scraper blades, and locking mechanisms disposed in the undercut for retaining the scraper blades in the slots. A unique method for forming and assembling the scraping tool is also disclosed. Such method includes the steps of machining the scraper blades while retaining same on the support body, and turning the support body to develop a compound curve on each blade element.

6 Claims, 12 Drawing Figures

FIG.6
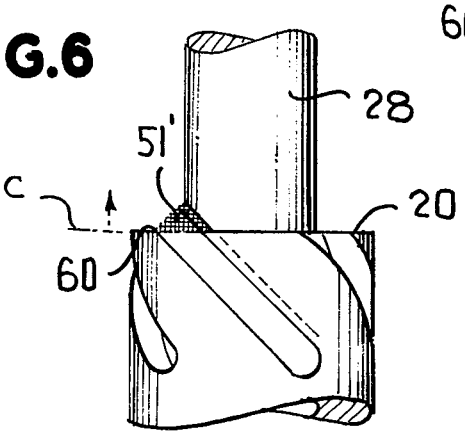
FIG.7
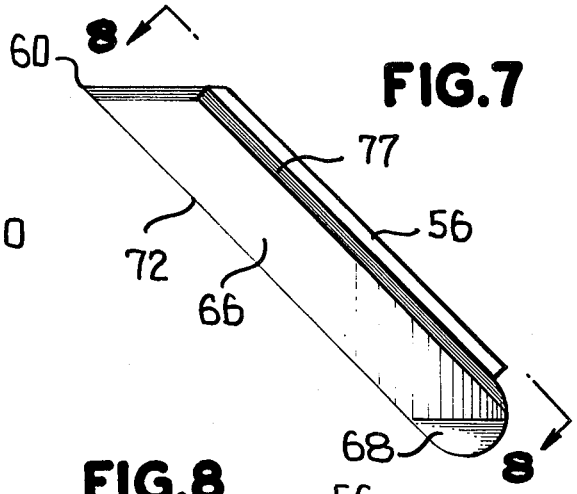
FIG.8
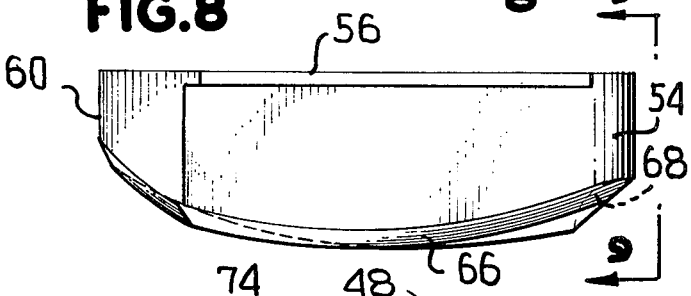
FIG.9
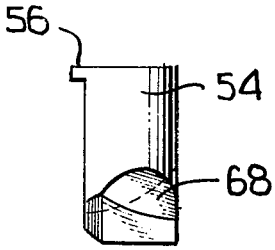
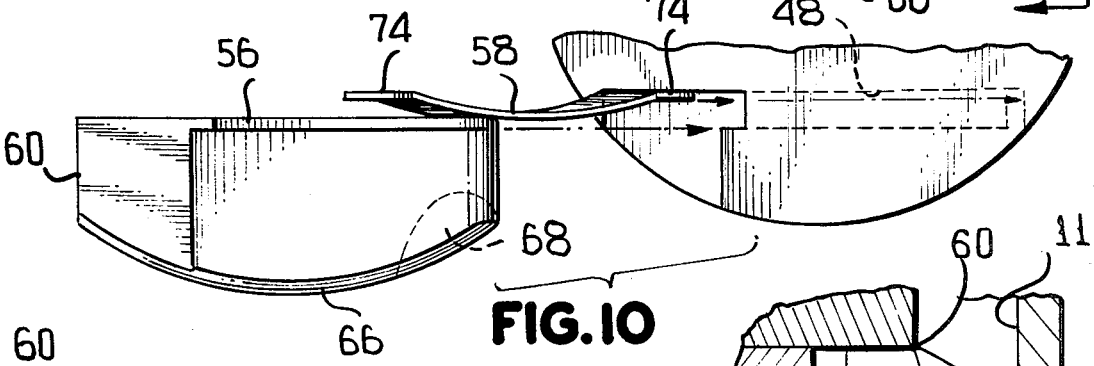
FIG.10
FIG.11
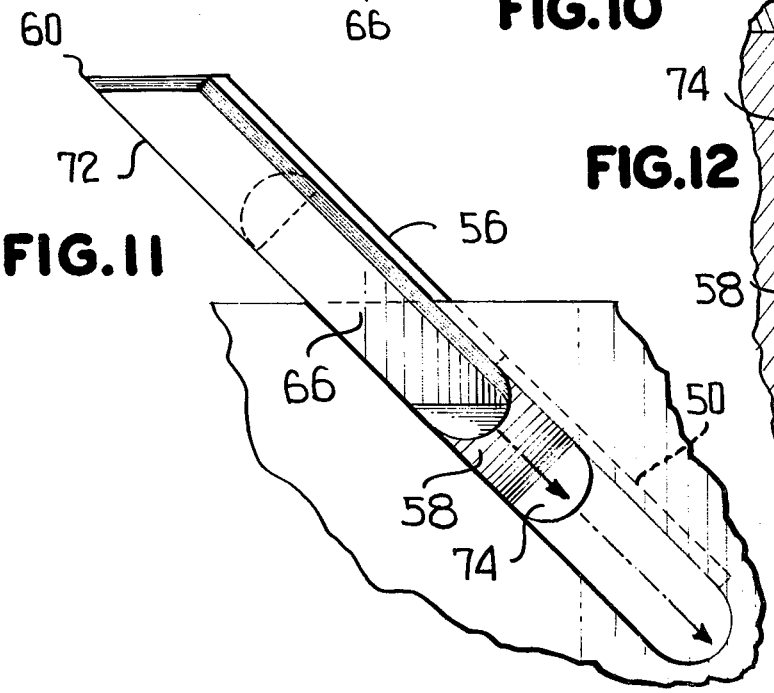
FIG.12
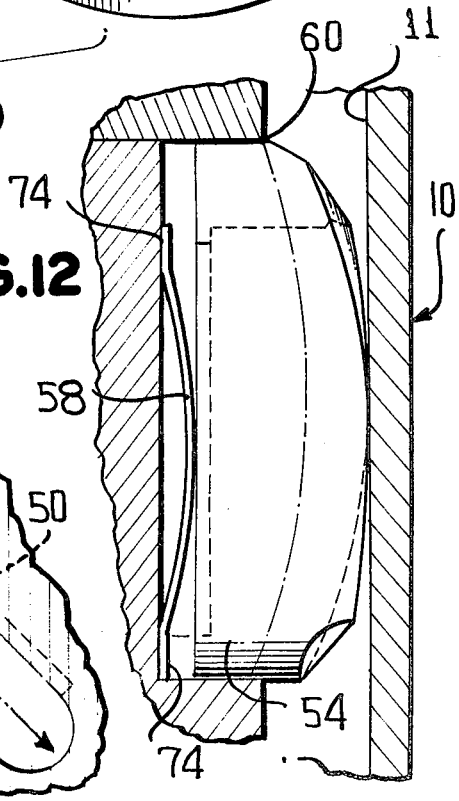

CASING SCRAPER AND METHOD FOR MAKING THE SAME

BACKGROUND OF THE INVENTION

1. Field of the Invention

The present invention pertains to devices for cleaning the inner walls of well casings, liners and similar conduits, and more particularly, to casing scrapers capable of scraping a film or cake of cement, mud, parafin, gun shot burrs, or any type of scaly materials, from the inner wall of such conduits.

2. Discussion of the Prior Art

Devices are known for scraping substances of the character mentioned above from the inner walls of well conduits; see, for example, the following patents listed below:

U.S. Pat. No. 1,664,283, Boynton
U.S. Pat. No. 2,275,939, Baker
U.S. Pat. No. 2,515,149, Willhoit
U.S. Pat. No. 2,667,930, Saurenman
U.S. Pat. No. 2,667,931, Baker
U.S. Pat. No. 2,695,673, Coyle
U.S. Pat. No. 2,804,152, Scivally
U.S. Pat. No. 2,811,210, Guillot
U.S. Pat. No. 2,838,121, Coyle
U.S. Pat. No. 2,845,129, Baker
U.S. Pat. No. 3,326,294, Neilson
U.S. Pat. No. 3,276,521, Turbyfill
U.S. Pat. No. 4,189,000, Best
U.S. Pat. No. Re. 24,766 Scivally.

Needless to say, the prior art is very highly developed, and because of the relatively massive character of the casing scraper involved, and the great depths at which it is raised and lowered within a well casing, for example, considerable torques and stresses are placed on the tool during its operation in the well casing.

Tools of the character involved have been provided with reversely directed blades, i.e., sets of blades which have reversed pitches so that the scraper is operative both on descent and ascent within the well casing; see, for example, the U.S. Pat. No. 1,664,283, to Boynton; the U.S. Pat. No. 2,515,149, to Willhoit; Saurenman, U.S. Pat. No. 2,667,930; or Coyle, U.S. Pat. No. 2,695,673.

A scraper tool must be readily manufactured and assembled, be of a construction to withstand the wear to which it is subjected, and the scraper blades per se should be readily replaceable. The prior art submitted above is the closest prior art of which the applicant is aware; however, the citation of this art should not be construed as a representation that no better art exists or that a search has been made.

SUMMARY OF THE INVENTION

A primary object of the invention is to provide a novel method for producing a novel well scraper tool in which each of the scraper blades is of an unusually strong cross-sectional construction for resisting wear and torque to which the blades are subjected to, and to provide a novel assembly of the scraper blades.

Another object of the invention is to provide a novel well scraper in which the scraper blades are assembled on a previously-milled or slotted blade support or mandrel and in which two sets of scraper blades are provided, and the respective sets of blades are reversely pitched with respect to each other in order that scraping of the inner surface of a well casing is effected during both raising and lowering of the scraper tool within the well casing.

A still further object of the invention is to provide a novel well scraper tool of the character mentioned above in which the scraper blades are turned or dressed on a lathe after having been assembled on the support mandrel of the tool for providing a scraper edge along the length of the blades; the respective blades being readily removed and replaced and being held in assembled position by means of a readily removeable stop collar.

The above, and other objects and advantages of the invention, will be apparent from the following description, constituting a specification of a preferred embodiment of the same, when taken with the annexed drawings.

BRIEF DESCRIPTION OF THE DRAWINGS

FIG. 6 is a diagrammatic view showing the manner in which the leading and effective cutter or chisel edge of the scraper blade elements is produced;

FIG. 7 is a top plan view of a scraper blade element, on a somewhat enlarged scale, illustrating the manner in which the scraper blade element is beveled or relieved on its trailing edge portions to facilitate movement of the scraper through a well casing;

FIG. 8 is a vertical elevation of a scraper blade element taken substantially on the plane of line 8—8 of FIG. 7;

FIG. 9 is an end elevation of FIG. 8 taken substantially on the plane of line 9—9 of FIG. 8;

FIG. 10 is a diagrammatic view illustrating an accommodation slot on the tool holder or mandrel and illustrating the manner in which the tool element and biasing spring are assembled on the mandrel;

FIG. 11 is a top plan view of FIG. 10 illustrating, progressively, the manner in which a tool element is assembled to the support mandrel; and FIG. 12 is an enlarged sectional view taken substantially on the plane of line 12—12 of FIG. 1.

DESCRIPTION OF A PREFERRED EMBODIMENT

Figure 1:
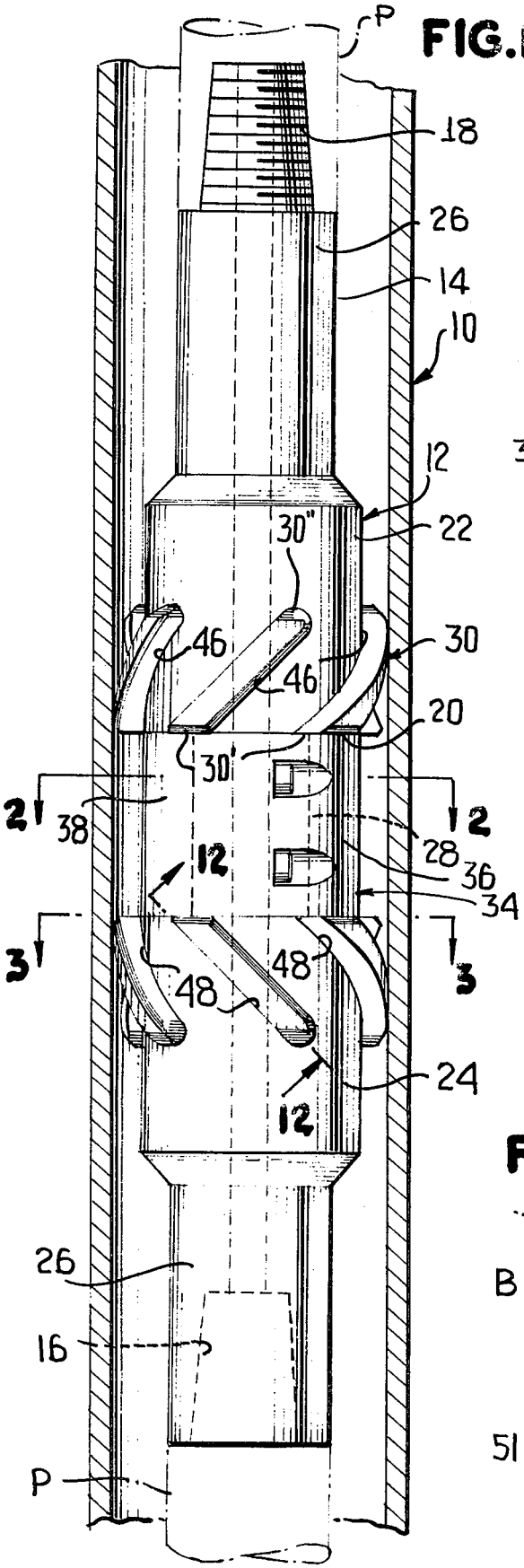
FIG. 1 is a vertical section of a portion of a well casing and the well scraper tool of the invention.

Referring first to FIG. 1, a fragmentary portion of the well casing is indicated generally at 10 and a casing scraper is indicated generally at 12. The casing scraper 12 comprises a one-piece integral body 14 produced on a lathe or the like from a suitable machine steel or alloy. The illustrated tool, for example, may be as much as 2–3 feet in length and wiegh perhaps 15–20 pounds, or more, and is generally connected at a lower internally threaded box 16 to a section of drill pipe P while the upper end of the tool body 14 incorporates an externally threaded pin end 18 which is likewise connected to a section of drill pipe P.

Briefly, the scraper tool 12, through the sections of drill pipe and conventional handling equipment available at the well, is raised and lowered the entire length of well casing which may involve thousands of feet, and thus, it is imperative that scraping be properly effected and impaction of the tool in the well casing be eliminated.

As previously mentioned, the tool body 14 is integral and of one piece including a central, circumferential groove 20 flanked on opposite sides by larger diameter scraper-blade-receiving lands 22 and 24, respectively. Extending from the lands 22 and 24 are reduced diameter portions 26 and 28, respectively, these reductions being primarily for the purpose of reducing the weight of the tool and facilitating movement of the tool through the casing.

Figure 2:
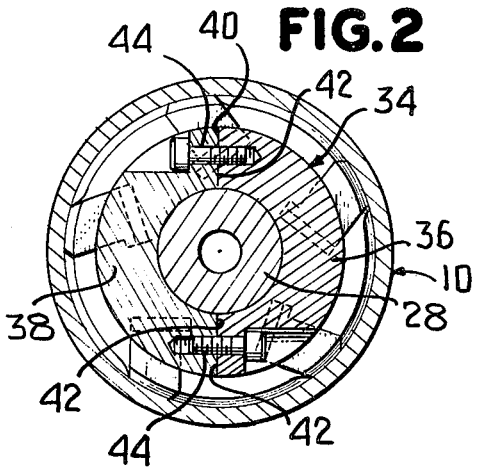
FIG. 2 is a transverse sectional view taken on the plane of line 2—2 of FIG. 1.
Figure 3:
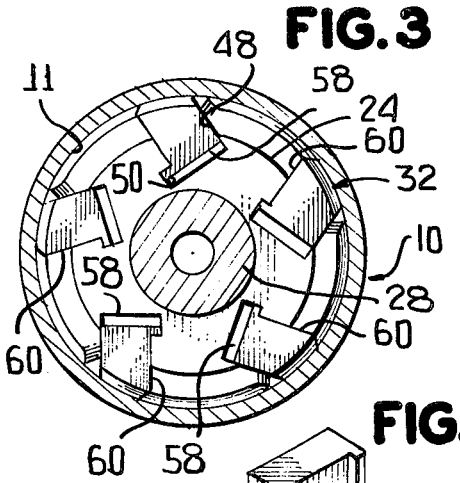
FIG. 3 is a transverse sectional view taken on the plane of line 3—3 of FIG. 1.

A central portion of the circumferential undercut or groove 20 extending completely around the body 14 is indicated at 28 and is best seen in FIGS. 2, 3 and 6.

Securely seated and removeably mounted in each of the respective lands 22 and 24 are sets of reversely-pitched scraper blade elements indicated generally at 30 and 32, respectively. Before describing the manner in which these blades are mounted, suffice it to say that the terminal ends of the blades of each of the respective sets are exposed at the undercut 20 of the tool. To retain the scraper blade elements in their assembled relation on the tool body, a lock ring indicated generally at 34 is circumposed about the tool body in the undercut 20; see FIG. 2 for this detail. The lock ring 34 comprises semicircular shells or halves 36 and 38 mating at their adjacent, juxtaposed inner longitudinal surfaces 40 and 42, respectively, and being suitably apertured and tapped to receive machine screws 44 for retaining the halves in assembled, locking relation on the undercut 20 of the tool body.

As best seen in FIGS. 1 and 3, the enlarged lands 22 and 24 each are milled out and have formed therein linear, dead-end slots 46 and 48, respectively, which extend angularly relative to the longitudinal axis of the tool body 14 and in essentially chordal relationship to the reduced diameter portion 28 of the tool body. As can be seen in FIG. 3 in which slots 48 appear, it is to be understood that slots 46 and 48 are of the same configuration; however, slots 46 are reversely pitched with respect to slots 48 and thus the scraper blade elements of one set tend to stabilize the other set when shaving material off the inner surface of the well casing. Each of the slots 46 and 48 includes, in the base thereof, a lateral section 50 which will accommodate a correspondingly conformed foot or flange of a scraper blade element to subsequently be described in detail. Although each of the sets of blades 30 and 32 is illustrated as comprising five blades, it is to be understood that depending upon the size and dimensions of the scraper tool, more or fewer blades can be suitably accommodated therein. However, the pitch of the respective scraper blade elements is such that the leading edge of each blade overlaps in a longitudinal sense the trailing end of a next adjacent blade so that a complete circumference of the tool is encompassed by a set of blades; see FIG. 1 where the leading or cutting edge of the blade is indicated at 30' while the trailing end is indicated at 30''.

Figure 5:
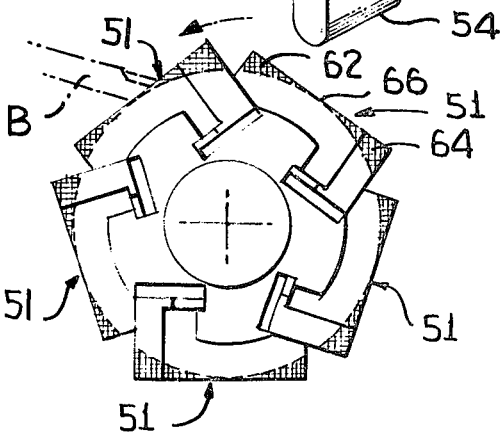
FIG. 5 is an elevation, similar in appearance to FIG. 3, showing the support mandrel or tool as it appears when mounted on a lathe, and illustrating in phantom lines those portions of the assembled scraper blade elements which will be machined away on the lathe.

Interestingly, although the slots 46 and 48 are linear, after the scraper blade elements of the respective sets of blades are turned on a lathe, as illustrated in FIG. 5, the blades assume a screw-like or corkscrew appearance.

Figure 4:
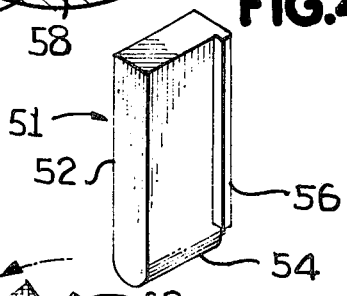
FIG. 4 is a fragmentary perspective view of a scraper blade blank prior to its assembly to the support mandrel and turning and beveling thereof.

In any event, each of the blade elements, as shown in FIG. 4, is produced from a rough blade blank 51 which comprises an elongated essentially rectangular body 52 radiussed at one end 54 and incorporating at its lower surface a laterally extending locking key or flange 56. It will be seen in FIG. 1 that the ends of the slots 46 and 48 remote from the undercut 20 are radiussed and this portion correspondingly receives the radiussed end 54 of the scraper tool element blanks 51.

At the base of each of the slots 46 and 48 is an elongated, longitudinally bowed, leaf spring 58, most clearly seen in FIG. 10, for example, which normally urges the respective scraper blade elements outwardly toward the outer surface of the lands 22 and 24.

METHOD OF PRODUCING THE SCRAPER TOOL

Initially, the support body 14 is turned on a lathe producing the undercut 20, lands 22 and 24, reduced in diameter portions 26, and the pin 18 and internally threaded socket 16. Next, the scraper blade blanks 51 and the underlying leaf springs 58 are slid into the slots 46 and 48, in the manner illustrated in FIG. 10, so that each of the slots has a scraper blade element 51 disposed therein with the terminal end projecting therebeyond as seen in FIG. 6.

With the blades disposed in their respective slots, in the manner just mentioned, a cut C is made on each of the respective blade elements, this cut coinciding with the undercut 20 and removing from each of the blade elements a terminal, triangular portion 51' which forms at the end of the tool an exposed cutting edge, or chisel edge, 60 which will project above the outer surface of the lands 22 and 24 as seen in FIG. 3. This edge engages debris which has accumulated on the inner surface 11 of the well casing and the spaces between the respective tool elements permit this debris to pass between adjacent scraper blade elements in the manner of a screw thread. As previously mentioned, sets of blades 30 and 32 act as reversed threads with respect to each other, and thus on descent of the blades, or ascent of the blades, one or the other thereof tends to stabilize and prevent rotation of the tool within the well casing being cleaned. Then portion 51' is removed from the respective blanks forming the aforementioned chisel edge 60 along the height thereof, this edge being removed by a suitable cutting tool, i.e., such as the tool bit B, as shown in FIG. 5. The lock collar 34 is installed and while the support 12 is on the lathe spindles, the circumference of the tool elements is developed, i.e., portions 62 and 64 are machined off the tool elements, or scraper blade elements. Since each scraper blade element is disposed in angular relationship or chordal relationship with respect to the longitudinal axis of the tool body, the outer blade surface has the appearance of an elliptical curve, which in fact conforms to the circumference of the well casing. The outer surface of the respective scraper blade elements is identified at 66, and its elliptical profile is perhaps best seen in FIGS. 8 and 12.

After the outer surface 66 of the scraper blade elements has been developed on the lathe, a bevel 68 is produced at the rounded end of the scraper blade element. Additionally, edge 70, parallel to a projection of the cutting edge 66, is likewise relieved or beveled. The cutting edge 72 continues along the entire length of the scraper blade element, and this cutting edge provides the function of scraping the inner surface of the well casing being cleaned.

Without describing the method of assembly in further detail, it is believed clear that the respective sets of scraper blades scrape the inner surface or walls of the casing both while going down the bore of the casing as well as when being withdrawn.

In the present invention, both the top and bottom sets of blades are beveled on the top side so they will not cut or scrape or become impacted in the metal of the well casing. If a sharp edge were left on the upper surface of these blade elements, it would probably catch and dig in as is customary in the prior art. Additionally, impaction of this tool in the well casing might tend to back off the connection between the pins and sockets of the well casing. Additionally, the reverse pitch of the respective sets of blades tend to counterbalance the blades in their engagement with the debris on the inner surface of the well casing and their movement longitudinally thereof during cleaning operation.

As is clearly apparent, removal of the lock ring 34 permits ready removal and replacement of any one or all of the scraper blade elements. As previously mentioned, and described with respect to FIG. 3, for example, the slots milled or cut into the lands 22 and 24 accommodate therein leaf springs 58 which are most clearly seen in FIG. 10. These leaf springs include at opposite ends thereof a generally upturned end 74 and these springs, together with a properly dressed or machined scraper blade element, are inserted longitudinally into the slots of the respective lands. The leaf springs 58 normally urge the scraper blade elements into engagement with the inner surface 11 of the well casing; see FIG. 12; however, springs also permit a certain amount of give or relief in the event the scraper blade elements engage a particularly resistant burr or the like, hardened cement, etc., formed on the inner surface of the well casing. Additionally, a flange 56 on the respective scraper blade elements retains the scraper blade elements in the slots accommodating the scraper blades.

Still further, and as seen in FIG. 3, for example, the scraper blade elements will have perhaps a third or more of the lowermost portion thereof flanked on opposite sides by the solid portion of the lands 22 and 24. This provides an extremely solid impaction surface for absorbing the torque imposed on the tool and the scraper blade elements as they are raised and lowered and attack debris on the inner surface of the well casing. FIG. 11 also illustrates the manner in which the scraper blade elements are inserted into an accommodating slot and can generally be considered a top plan view of the installation procedure illustrated in FIG. 10.

Numerous changes and modifications that could be made to the preferred embodiment will occur to the skilled artisan to which this invention relates without departing from the spirit of the appended claims. Consequently, the appended claims should be broadly construed in a manner consistent with the significant advance in the useful arts and sciences, and should not be limited to their literal terms.

What is claimed is:

1. In a well scraping tool including a unitary generally cylindrical body having two sets of slots therein and an outwardly biased cutter blade within each of said slots, the improvement wherein:

each of said slots is undercut along its length; said improvement further comprising a longitudinal flange on each blade, said flange extending laterally from one side of said blade for the length thereof, said flange engaging a respective one of said undercuts to retain the blade within the body;

said body having a circumferential groove between said slots and intersecting an adjacent end of each slot, said groove extending completely around said body and having sufficient width and depth to allow for lengthwise insertion and removal of said blades from their respective slots; and a locking ring removably secured within said groove to prevent lengthwise movement of the blades within their grooves.

2. The tool improvement recited in claim 1 wherein said locking ring comprises: two identical semi-cylindrical shell portions, and threaded fasteners for securing said portions together within said groove.

3. The tool improvement recited in claim 1 wherein the ends of said slots remote from said locking ring are rounded and the corresponding ends of said blades are correspondingly rounded.

4. The tool improvement recited in claim 3, wherein the rounded ends of said blades are bevelled to prevent said ends from digging into the well casing.

5. The tool improvement recited in claim 4 wherein said slots are oblique with respect to the axis of the tool and said sets of said slots have opposite inclination.

6. The tool improvement recited in claim 5 wherein each blade in a given set has a leading end and a trailing end, and the leading end of one blade, when projected longitudinally, overlaps the trailing end of the next adjacent blade in the set whereby each set of elements defines a complete circumferential scraping surface with intermediate openings for debris and well fluids to pass through.

* * * * *